US006106036A

United States Patent [19]

Okada et al.

[11] Patent Number: 6,106,036

[45] **Date of Patent: *Aug. 22, 2000**

[54] DOOR HANDLE FOR A VEHICLE

[75] Inventors: Shinji Okada; Kenji Kobashi, both of Toyota; Toshikatsu Hemmi, Toyokawa, all of Japan

[73] Assignee: Toyota Jidosha Kabushiki Kaisha, Toyota, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,810

[22] Filed: Mar. 25, 1997

[30] Foreign Application Priority Data

Mar. 26, 1996 [JP] Japan ..... 8-070313

[51] Int. Cl.[7] ..... E05B 3/00

[52] U.S. Cl. ..... 292/336.3; 292/DIG. 37; 74/110

[58] Field of Search ..... 292/336.3, 225, 292/DIG. 37, DIG. 25, 92, 170; 16/110 R; 74/501.6, 502, 502.6, 110, 538

[56] References Cited

U.S. PATENT DOCUMENTS

| | | | |
|---|---|---|---|
| 2,648,351 | 8/1953 | Curtis | 74/110 |
| 3,113,798 | 12/1963 | Kramer | 292/336.3 |
| 3,127,206 | 3/1964 | Jakeway | 292/DIG. 37 |
| 3,707,845 | 1/1973 | Mitton | 74/110 |
| 4,883,296 | 11/1989 | Lavrie | 292/336.3 |
| 5,558,372 | 9/1996 | Kapes | 292/DIG. 37 |

FOREIGN PATENT DOCUMENTS

| | | |
|---|---|---|
| 57-185862 | 5/1956 | Japan . |
| 63-037766 | 3/1988 | Japan . |

*Primary Examiner*—Anthony Knight
*Assistant Examiner*—Gary Estremsky
*Attorney, Agent, or Firm*—Pillsbury Madison & Sutro LLP

[57] ABSTRACT

Disclosed is a door handle for a vehicle that includes an operation button which is pushed so as to unlock a door of the vehicle. The door handle includes a handle base plate to which the operation button is attached. A sliding wall is provided on the handle base plate and is in sliding contact with the operation button and guides the operation button. An arm has one end that moves linearly in a direction substantially orthogonal to the door when one end of the arm is pressed due to the operation button being pressed. Guiding structure is provided between the arm and the handle base plate. The guiding structure provides fixed guiding surfaces which slidably guide another end of the arm in a direction extending along the door when the arm moves. An unlocking cable is connected to the arm and is operable to unlock the door. Urging structure is configured to urge the arm in a direction such that the operation button returns to a position at which the operation button was located before being pressed.

40 Claims, 10 Drawing Sheets

DOOR HANDLE FOR A VEHICLE

BACKGROUND OF THE INVENTION

1. Field of the Invention

The present invention relates to a door handle for a vehicle, and more particularly to a door handle for a vehicle that is provided with an operation button for unlocking a door of the vehicle.

2. Description of the Related Art

Conventionally, there has been known a door handle for a vehicle that has a door-unlocking button provided at one longitudinal end of the handle. Japanese Utility Model Application Laid-Open (JP-U) Nos. 63-37766 and 57-185862 disclose examples of the structure of such a door handle. A description will now be given of the door handle disclosed in Japanese Utility Model Application Laid-Open (JP-U) No. 57-185862.

As shown in FIG. 9, a door handle 70 for a vehicle is designed such that while gripping a grip portion 72*a*, a passenger depresses a push button 74 against urging force of a spring 76.

As shown in FIG. 10, when the push button 74 is depressed from a position indicated by a solid line to a position indicted by a two-dot chain line, a bell crank 78 rotates in the clockwise direction (i.e., in the direction indicated by arrow Y) in FIG. 10 about a shaft 80 and reaches a position indicated by a two-dot chain line. With this operation, a rod 82 moves from a position indicated by a solid line to a position indicted by a two-dot chain line, so that the engagement between a door lock and a striker provided on a body side (both unillustrated) is canceled.

However, in the door handle 70, when the push button 74 is depressed as shown in FIG. 10, a shaft 84 connected to the push button 74 moves toward the inside of the door (i.e., the direction indicated by arrow X in FIG. 10). The stroke of the shaft 84 determines the rotational angle of the bell crank 78 and the amount by which the rod 82 is lowered.

Accordingly, it is necessary to maintain a large space for movement of the shaft 84 within the door at a location corresponding to the push button 74 and to provide a space for rotation of the bell crank 78. Therefore, when the conventional door handle 70 is employed, the door must have a large thickness at a location where the handle 70 is attached.

SUMMARY OF THE INVENTION

In view of the foregoing fact, it is an object of the present invention is to provide a door handle for a vehicle that can decrease the thickness of a door at a location where the door handle is attached.

According to a first aspect of the present invention, there is provided a door handle for a vehicle including an operation button that is pushed so as to unlock a door of the vehicle. The door handle includes a handle base plate to which the operation button is attached, and a sliding wall provided on the handle base plate. The sliding wall is in sliding contact with the operation button and guides the operation button. There are further provided an arm, guide means, an unlocking cable, and urging means. The arm moves when one end of the arm is pressed due to the operation button being pressed. The guide means is provided between the arm and the handle base plate and is adapted to move the other end of the arm in a direction along a door attachment surface of the handle base plate when the arm moves. The unlocking cable is connected to the arm and is operable to unlock the door. The urging means urges the arm in a direction such that the operation button returns to a position at which the operation button was located before being pressed.

Accordingly, when the operation button is pressed so that the operation button slides along the sliding wall while being guided thereby, one end of the arm is pressed by the operation button so that the arm is moved. At this time, the other end of the arm moves in the direction along the door attachment surface of the handle base plate. Due to this movement, the unlocking cable connected to the arm is drawn in an unlocking direction, so that the door is unlocked. Accordingly, the door handle of the present invention has an excellent effect of decreasing the thickness of the door at the location where the door handle is attached to the door.

According to a second aspect of the present invention, the arm is bent toward the door attachment surface of the handle base plate.

Accordingly, the arm does not interfere with the sliding wall of the handle base plate even when the operation button is pressed. Moreover, the space on the door attachment surface around the operation button can be minimized.

DESCRIPTION OF THE PREFERRED EMBODIMENTS

A door handle according to an embodiment of the present invention will now be described with reference to FIGS. 1–5.

In these drawings, arrow FR indicates a direction toward the front end of a door, arrow UP indicates a direction toward the top of the door, and arrow IN indicates a direction toward the interior of the door. Hereinafter, "inner side of the door" denotes the surface of the door facing the interior of the vehicle, and "outer side of the door" denotes the surface of the door facing the exterior of the vehicle.

Figure 1:
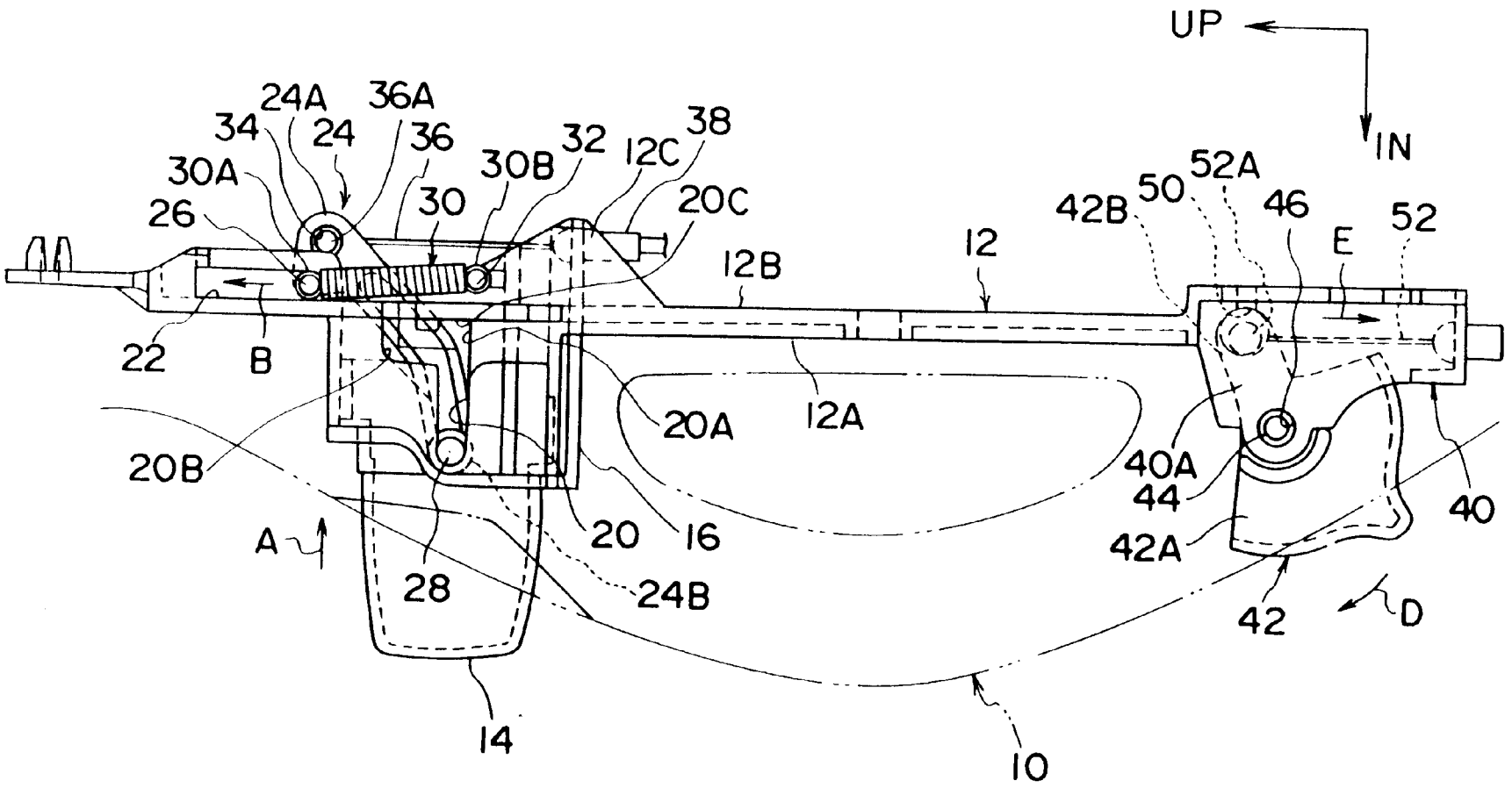
FIG. 1 is a side view of a door handle for a vehicle according to an embodiment of the present invention.

As shown in FIG. 1, in the present embodiment, a door handle 10 is integrally formed on a door trim provided on the inside of a door, and a handle base plate 12 is disposed on the back surface of the door trim. The handle base plate 12 extends in the vertical direction of the door. An operation button 14 is disposed on the upper portion of a door attachment surface 12A of the handle base plate 12 such that the operation button 14 can be pressed in a direction toward the outside of the door (in the direction indicated by arrow A in FIG. 1).

Figure 2:
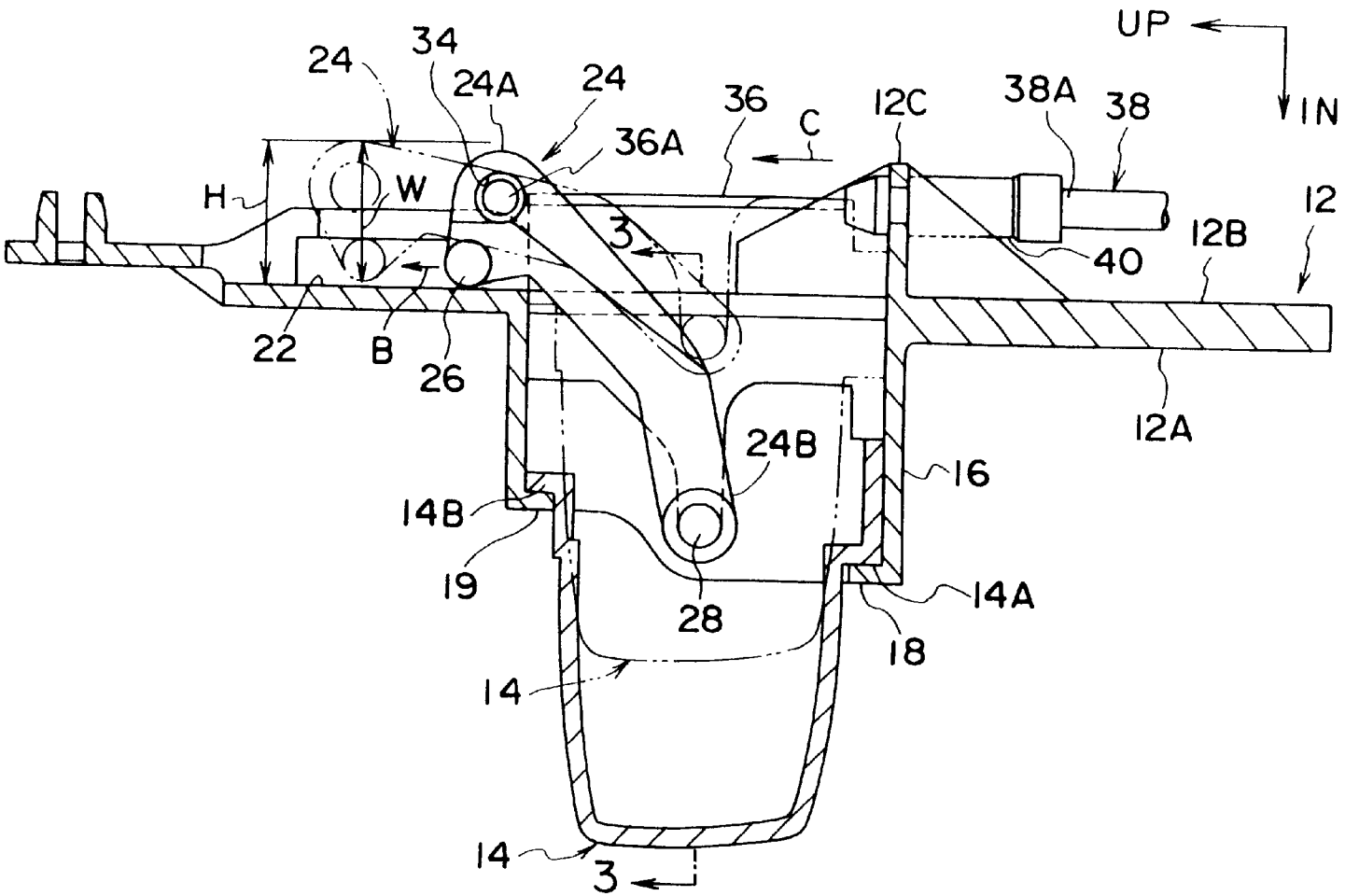
FIG. 2 is a side sectional view showing the upper portion of the door handle for a vehicle according to the embodiment of the present invention.

As shown in FIG. 2, on the upper portion of the door attachment surface 12A of the door base plate 12 is provided an operation button support portion 16 that has a rectangular tubular shape and that projects toward the inside of the door. At the lower-side portion of the inner-side opening of the operation button support portion 16 is formed a projection 18 that projects toward the center of the opening. A stepped portion 14A, which projects downward from the lower portion of the peripheral wall of the operation button 14, is formed in the vicinity of the base portion of the operation button 14. This stepped portion 14A is engaged with the projection 18 of the operation button support member 16. Moreover, a projection 19, which projects toward the center of the opening, is formed at the upper-side portion of the inner-side opening of the operation button support portion 16. A stepped portion 14B, which projects upward from the upper portion of the peripheral wall of the operation button 14, is formed in the vicinity of the base portion of the operation button 14. This stepped portion 14B is engaged with the projection 19 of the operation button support member 16.

Figure 3:
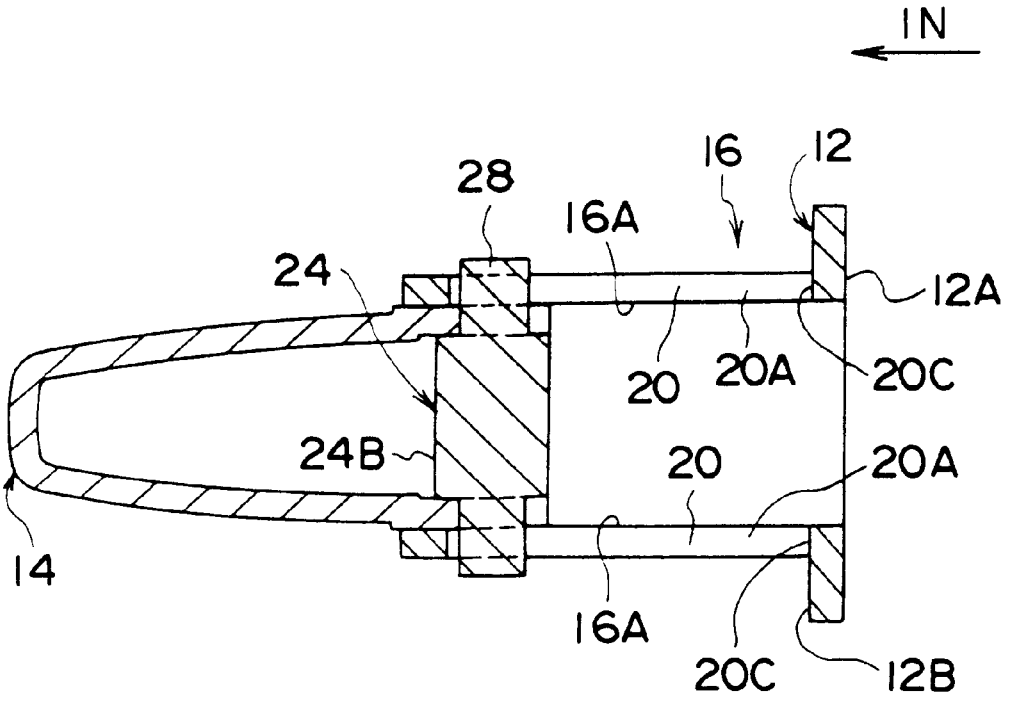
FIG. 3 is a sectional view taken along line 3—3 in FIG. 2.

As shown in FIG. 3, each of the front and rear walls of the operation button support portion 16 serves as a sliding wall 16A that is in contact with part of the peripheral surface of the operation button 14 and guides sliding movement of the operation button 14. Formed in each sliding wall 16A is a guide slit 20 that extends perpendicularly with respect to the door attachment surface 12A of the handle base plate 12.

Figure 4:
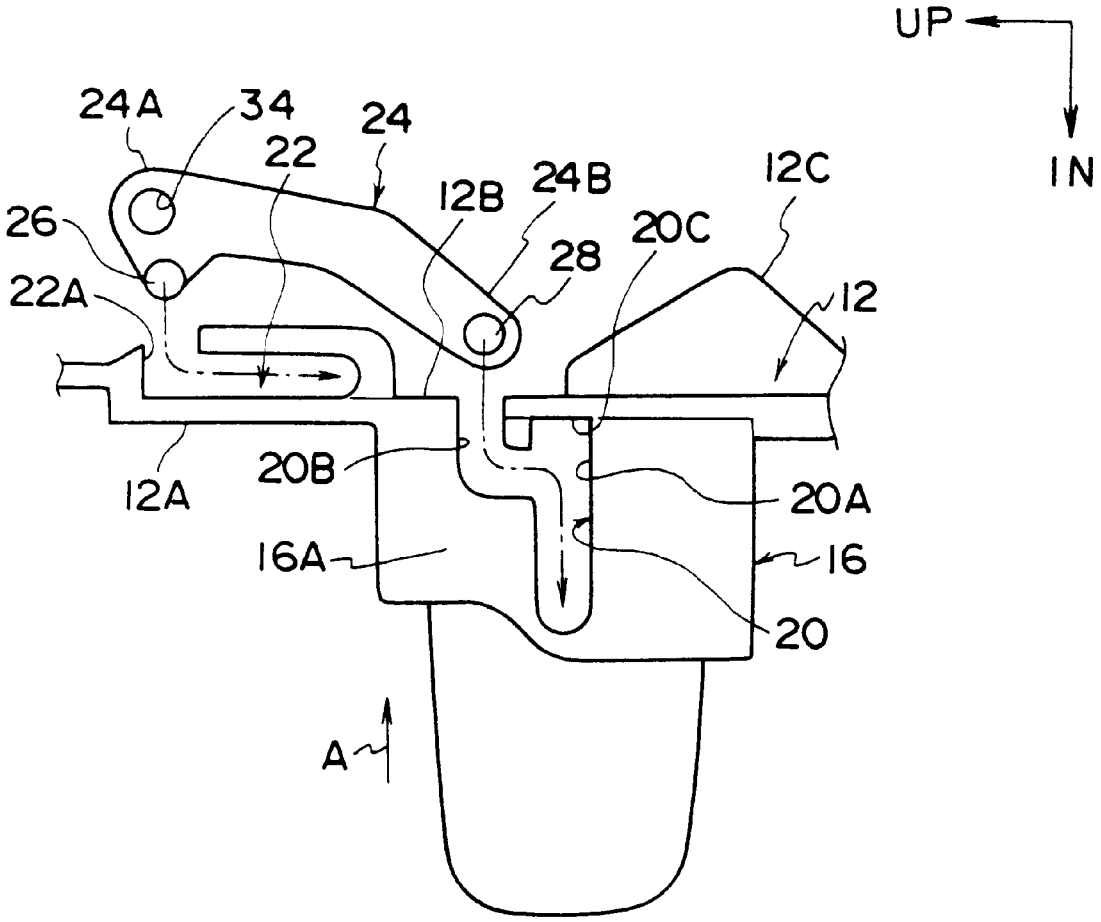
FIG. 4 is a side view showing the upper portion of the door handle for a vehicle according to the embodiment of the present invention.

As shown in FIG. 4, each of the guide slits 20 has a substantially h-like shape as viewed from the side. A branch portion 20B is formed above a straight base portion 20A. The bottom end 20C of the base portion 20A of the guide slit 20 is closed, while the bottom end of the branch portion 20B is opened.

At the upper portion of an outer side surface 12B (i.e., a surface facing the outside of the door) of the handle base plate 12 is formed guide slits 22 that extend in the vertical direction of the door along the door attachment surface 12A of the handle base plate 12 and that serves as guiding structure. The longitudinal direction of the guide slits 22 is perpendicular to the longitudinal direction of the guide slits 20. At the upper end portion of each guide slit 22 is formed an opening 22A that faces the outside of the door.

On the outer side surface 12B of the handle base plate 12 there is disposed an arm 24 that extends in the vertical direction of the door along the door attachment surface 12A of the handle base plate 12. The arm 24 is bent at its approximate longitudinal center such that one end portion approaches the door attachment surface 12A of the handle base plate 12.

Cylindrical protrusions 26, which project from the upper end portion 24A in a direction substantially perpendicular to the longitudinal direction of the arm 24 and which serve as a guide means, are provided at the upper end portion 24A of the arm 24. As indicated by an arrow in FIG. 4, the protrusions 26 can be moved into the guide slits 22 through the openings 22A.

Cylindrical protrusions 28, which project from the lower end portion 24B in a direction substantially perpendicular to the longitudinal direction of the arm 24 and which serve as an auxiliary guiding structure, are provided at the lower end portion 24B of the arm 24. The protrusions 28 can be moved into the base portions 20A of the guide slits 20 through the branch portions 20B. The protrusions 28 are disposed such that they abut the end portion of the operation button 14 that face the outside of the door.

Figure 5:
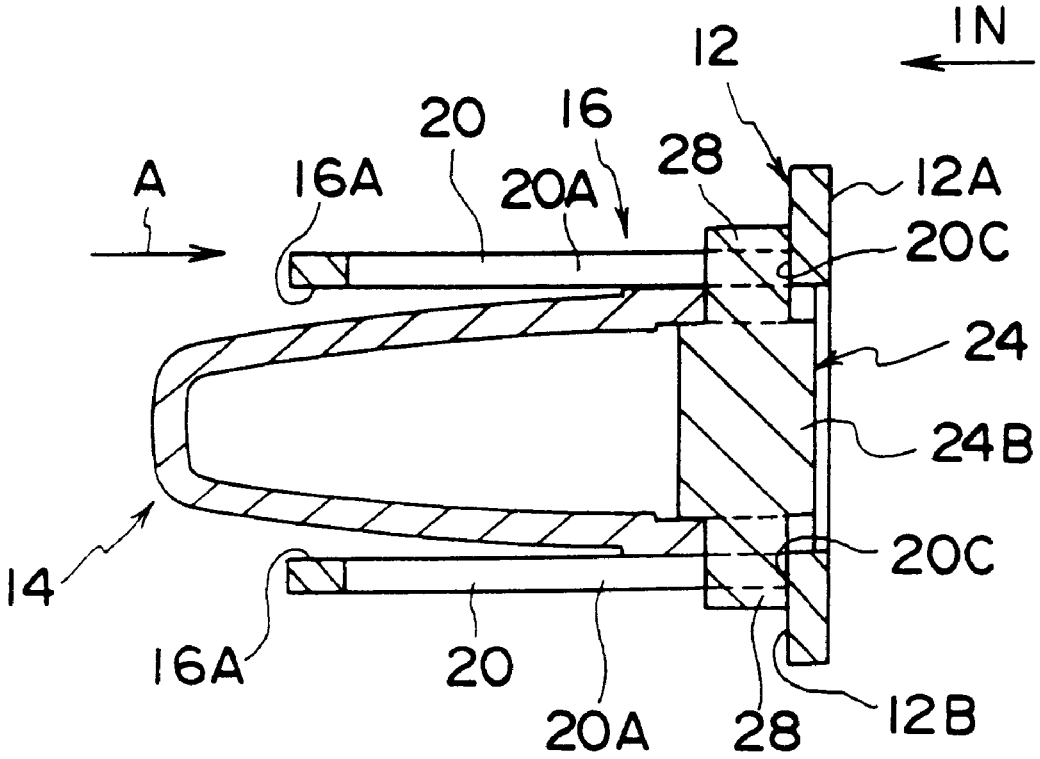
FIG. 5 is a sectional view corresponding to FIG. 3 and showing a state in which an operation button of the door handle, according to the embodiment of the present invention, is pushed.

As shown in FIG. 5, upon pressing operation of the operation button 14, the protrusions 28 of the arm 24 move in the direction of arrow A along the guide slits 20 and abut the bottom portions 20C of the guide slits 20.

Accordingly, as shown in FIG. 1, when the operation button 14 moves in the direction of arrow A, the protrusions 28 of the arm 24 moves in the direction of arrow A in FIG. 1 while being guided by the guide slits 20. At the same time, the protrusions 26 of the arm 24 moves in a direction along the door attachment surface 12A of the handle base plate 12 (in the direction of arrow B in FIG. 1) while being guided by the guide slits 22. As a result, as shown in FIG. 2, the lower end portion 24B of the arm 24 moves from a position inside the operation button support member 16 (a position indicated by a solid line in FIG. 2) to a position along the handle base plate 12 (a position indicated by a two-dot chain line in FIG. 2).

As shown in FIG. 1, one end portion 30A of a coil spring 30 that serves as a biasing element is in engagement with the protrusion 26 of the arm 24, while the other end portion 30B of the coil spring 30 is in engagement with a pin 32. The pin 32 projects from the upper end portion of an engagement portion 12C that projects from the substantially vertical direction central portion of the outer side surface 12B of the handle base plate 12. The coil spring 30 urges the protrusion 26 of the arm 24 downward (in a direction opposite the direction of arrow B in FIG. 1). Therefore, in a normal state, the arm 24 is located at the position shown in FIG. 1 due the urging force of the coil spring 30, and the operation button 14 is located at its projected position (the position shown in FIG. 1).

As shown in FIG. 2, a cable engagement hole 34, which is formed on the side of the protrusions 26 closer to the outside of the door, is provided at the upper end portion 24A of the arm 24. One end portion 36A of an unlocking cable 36 is engaged with the cable engagement hole 34. Although not shown in the drawings, the other end portion of the unlocking cable 36 is connected to a door unlocking device.

Accordingly, when the arm 24 is moved from the position indicated by the solid line to the position indicated by the two-dot chain line in FIG. 2 against the urging force of the coil spring 30, the end portion 36A of the unlocking cable 36 is pulled, so that the unlocking cable 36 moves toward the upper end of the door (i.e., in the direction of arrow C in FIG. 2). With this operation, the door is unlocked.

As shown in FIG. 1, at the lower portion of the handle base plate 12, a lock knob support portion 40 is formed such that it projects toward the inside of the door. A lock knob 42 is supported by the lock knob support portion 40 such that the lock knob 42 can be swung toward the upper end of the door (i.e., in the direction of arrow D in FIG. 1) and toward the lower end of the door (i.e., In the direction opposite the direction of arrow D in FIG. 1). On walls 42A of the lock knob 42 that extend perpendicularly to the swing direction of the lock knob 42 are formed cylindrical projections 44. The cylindrical projections 44 are inserted into holes 46 formed in wall portions 40A of the lock knob support portion 40.

In an end portion 42B of the lock knob 42 closer to the outside of the door is formed a cable engagement hole 50. One end 52A of a cable 52 is engaged with the cable engagement hole 50. Although not shown in the drawings, the other end of the cable 52 is connected to a door locking mechanism. When the lock knob 42 is rotated in the direction of arrow D from the position indicated by the solid line in FIG. 1, the cable 52 moves toward the lower end of the door (i.e., in the direction of arrow E in FIG. 1), so that the door is brought into an unlockable state.

Next, operation of the present embodiment will be described.

In the present embodiment, the lock knob 42 is first rotated in the direction of arrow D in FIG. 1 so as to make the door unlockable. In this state, when a passenger grips the door handle 10 and pushes the operation button 14 in the direction of arrow A with a fingertip, the operation button 14 moves within the operation button support portion 16 of the handle base plate 12.

Due to the movement of the operation button 14, the lower end portion 24B of the arm 24 is moved in the direction of arrow A, as shown in FIG. 5, via the protrusions 28 formed on the lower end portion 24B and being in engagement with the operation button 14. At this time, as shown in FIG. 1, the protrusions 28 move along the base portions 20A of the guide slits 20 against the urging force of the coil spring 30, and the projections 26 move along the guide slits 22. When the arm 24 moves from the position indicated by the solid line to the position indicated by the two-dot chain line in FIG. 2, the end portion 36A of the unlocking cable 36 is pulled, so that the unlocking cable 36 moves toward the upper end of the door (in the direction of arrow C in FIG. 2). As a result, the door is unlocked.

Meanwhile, when the finger is removed from the operation button 14, the arm 24 moves from the position indicated by the two-dot chain line to the position indicated by the solid line in FIG. 2. Due to this movement of the arm 24, the unlocking cable 36 moves toward the lower end of the door (in the direction opposite the direction of arrow C in FIG. 2), so that the operation button 14 returns to the position assumed by the operation button 14 before being pressed.

Figure 9:
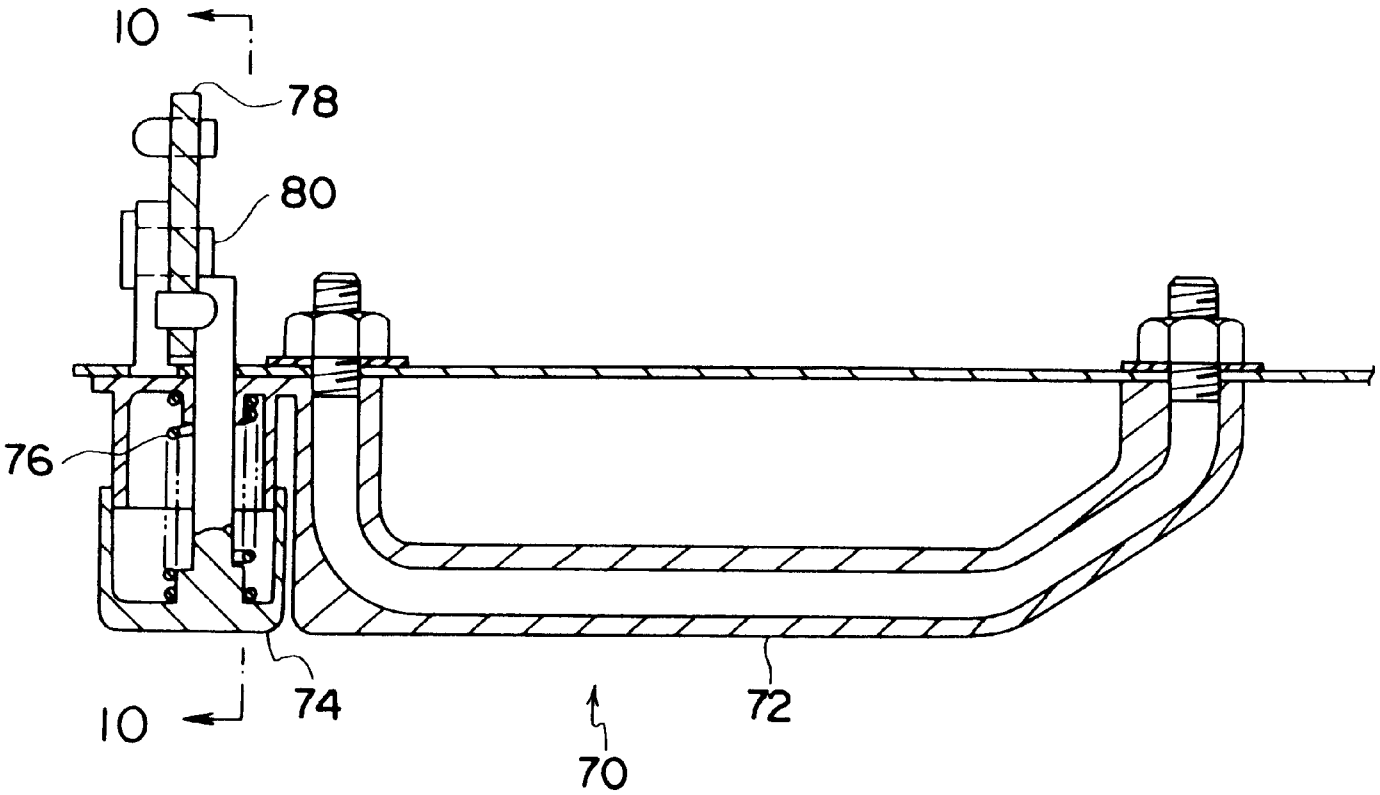
FIG. 9 PRIOR ART
FIG. 9 is a horizontal sectional view of a conventional door handle for a vehicle.
Figure 10:
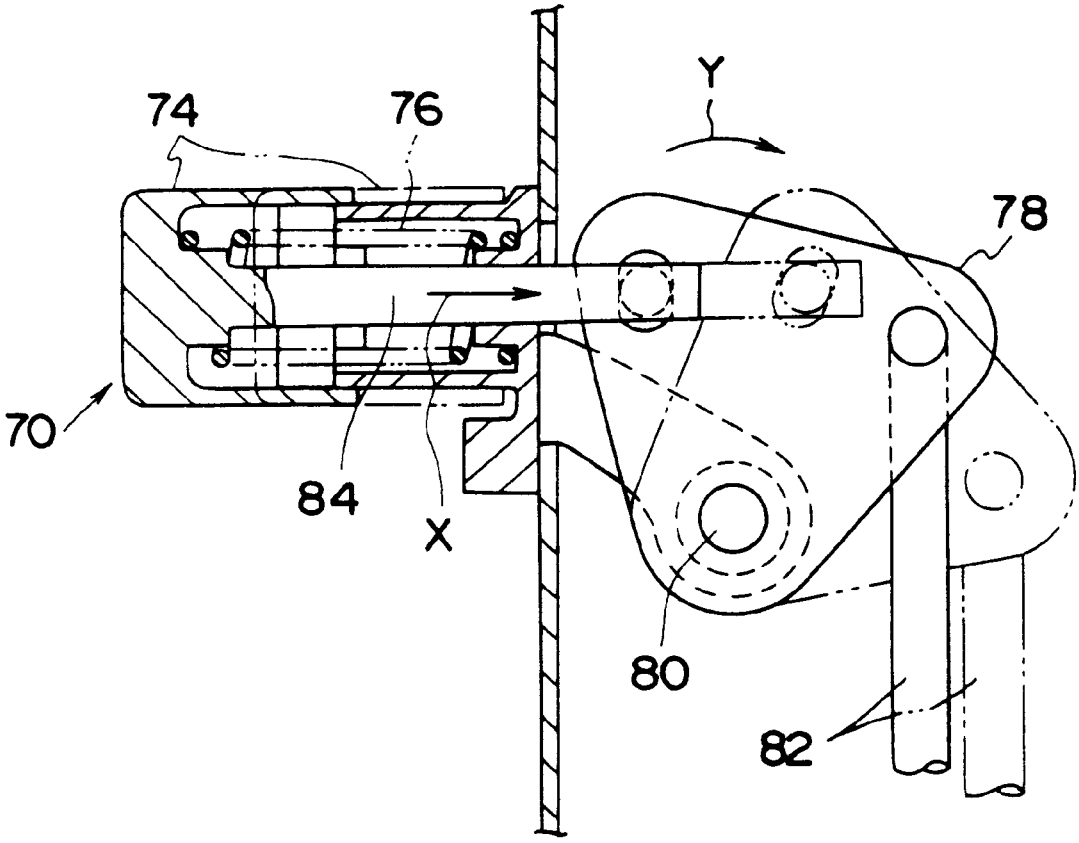
FIG. 10 PRIOR ART
FIG. 10 is a sectional view taken along line 10—10 in FIG. 9.

Accordingly, in the present embodiment, the amount of projection of the arm 24 from the outer side surface 12B of the handle base plate 12 is very small, as shown in FIG. 2, even when the operation button 14 is pressed. That is, the distance H from the outer side surface 12B of the handle base plate 12 that is necessary for movement of the arm 24 is substantially equal to the maximum width W of the upper end portion 24A of the arm 24. Accordingly, the door thickness at the location where the door handle is attached can be decreased as compared to the conventional door handle shown in FIGS. 9 and 10.

Moreover, in the present embodiment, the arm 24 is bent at about its longitudinal center such that one end of the arm approaches toward the door attachment surface 12A of the handle base plate 12. Accordingly, the arm 24 does not interfere with the sliding wall 16A of the operation button support portion 16 even when the operation button 14 is pressed, so that the space on the door attachment surface around the operation button 14 can be minimized.

Moreover, in the present embodiment, since the guide means is formed by the guide slits 22 and the protrusions 26, the structure is simple.

In the present embodiment, the guides slits 20 that extend substantially perpendicularly to the door attachment surface 12A of the handle base plate 12 and the protrusions 28 of the arm 24 that move within the guide slits 20 are provided as an auxiliary guiding structure. Therefore, the arm 24 can be reliably moved in the direction perpendicular to the door attachment surface 12A by the guidance provided by the guide slits 20 and the protrusions 28.

Figure 6:
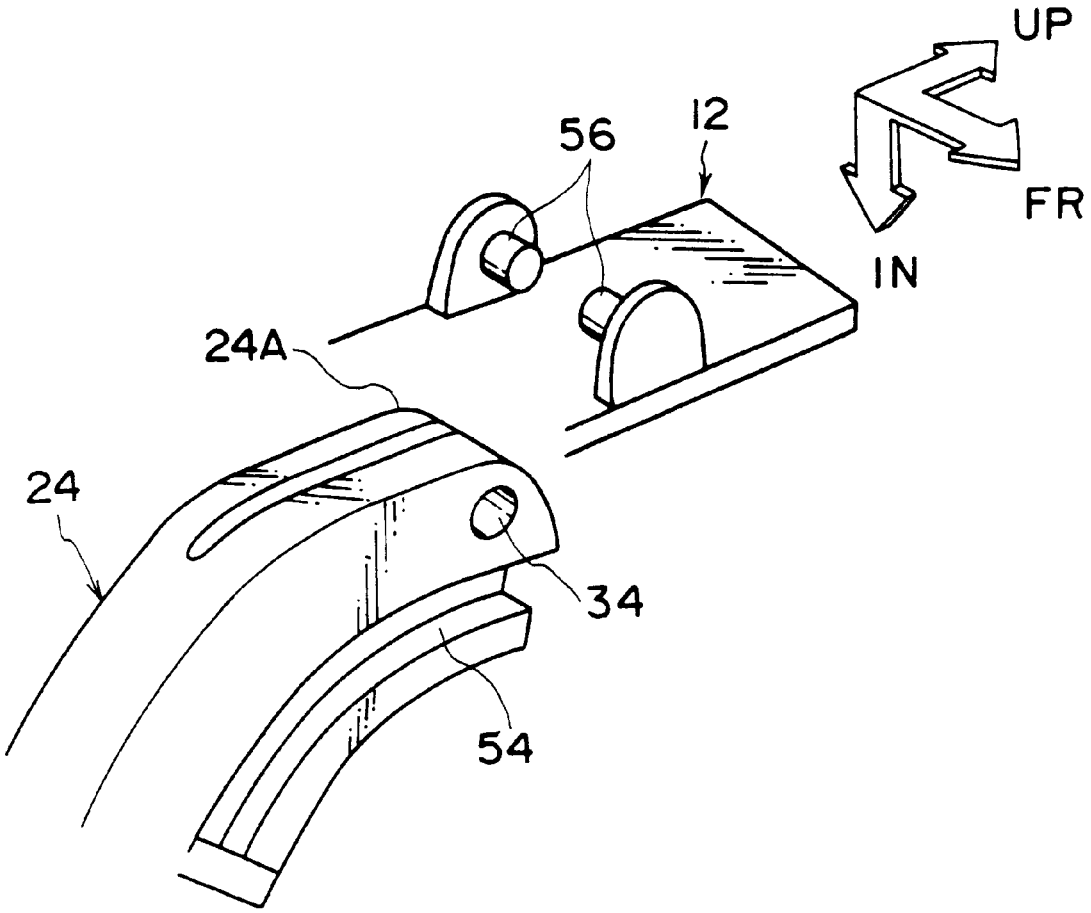
FIG. 6 is a perspective view showing guide means of a door handle for a vehicle according to another embodiment of the present invention.

In the door handle for a vehicle according to the present embodiment, as shown in FIG. 1, the guide slits 22 are formed on the handle base plate 12, while the protrusions 26 that move within the guide slits 22 are formed on the arm 24. However, the present invention is not limited thereto. As shown in FIG. 6, guide slits 54 may be formed in the arm 24 as a guiding structure such that the guide slits 54 extends along the substantially longitudinal direction of the arm 24, and protrusions 56 may be formed on the handle base plate 12 as a guiding structure such that the protrusions 56 are movable within the guide slits 54.

Figure 7:
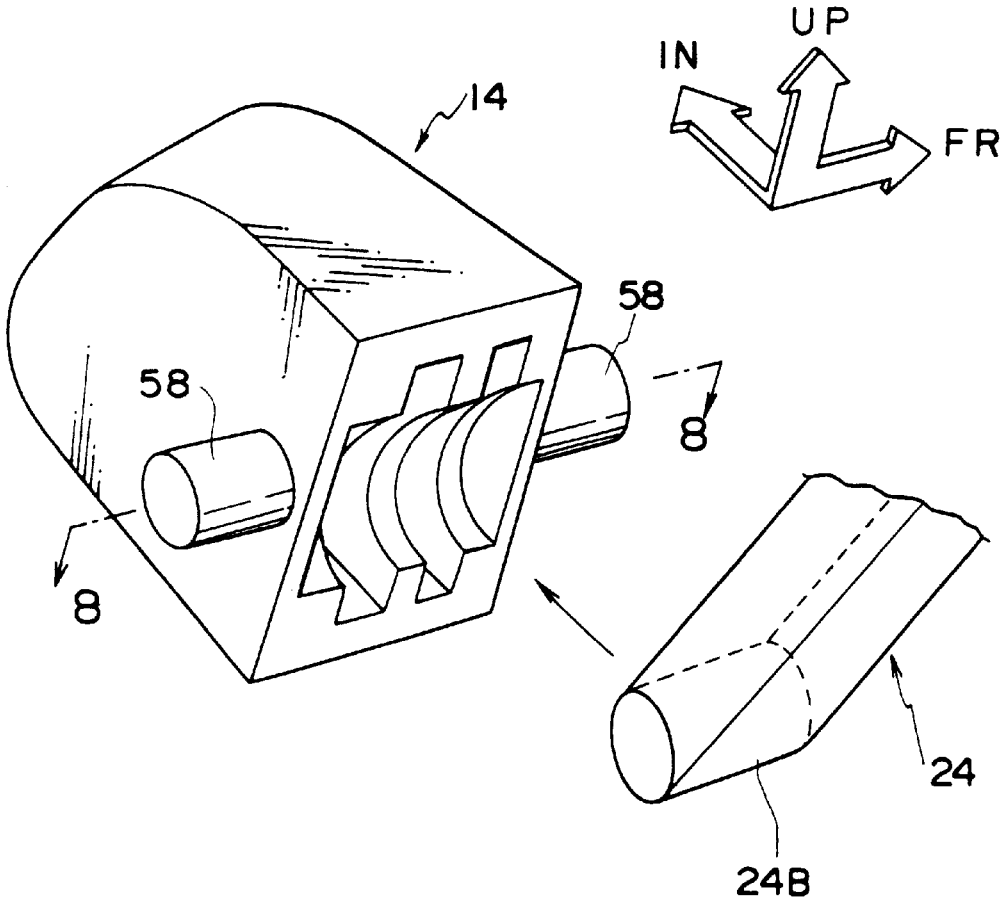
FIG. 7 is a perspective view showing the abutment between the lower end portion of an arm and an operation button of a door handle for a vehicle according to another embodiment of the present invention.
Figure 8:
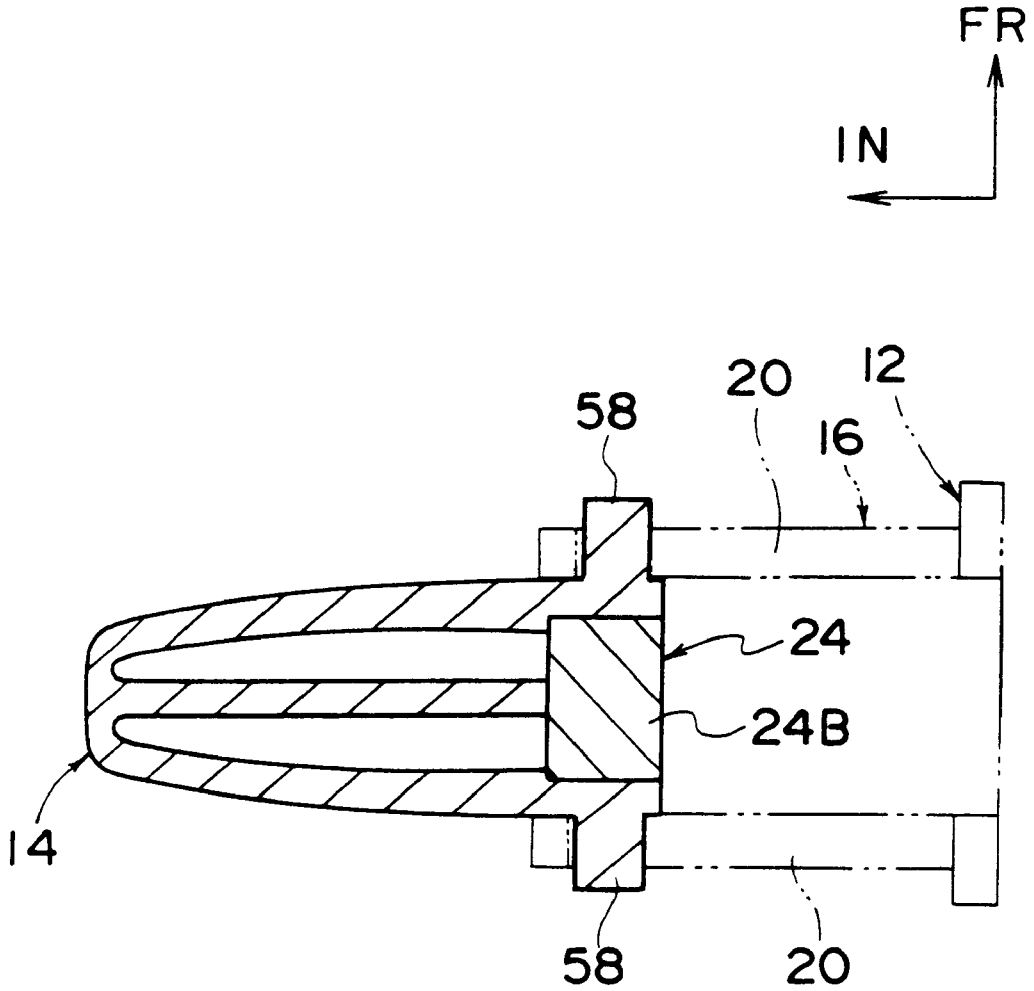
FIG. 8 is a sectional view taken along line 8—8 in FIG. 7.

In the door handle for a vehicle according to the present embodiment, as shown in FIG. 3, the protrusions 28 are formed on the lower end portion 24B of the arm 24, and the protrusions 28 are moved within the guide slits 20. However, the present invention is not limited thereto. As shown in FIGS. 7 and 8, protrusions 58 may be formed on the operation button 14 as an auxiliary guiding structure, and the protrusions 58 may be moved within the guide slits 20. The protrusions 58 function as stoppers that prevent the operation button 14 from coming off in the pressing direction Therefore, when there is provided a stopper that prevents the arm 24 or the operation button 14 from moving beyond a predetermined range that extends toward the outside of the door, the guide slits 20 and the protrusions 28, 58 that serve as an auxiliary guiding structure may be omitted.

Although the specific embodiments of the present invention are described above, the present invention is not limited to those embodiments. It is apparent to those skilled in the art that other various embodiments may be practiced without departing from the scope of the invention. For example, although the door handle for a vehicle of the present invention is applied to a door inner handle in the above-described embodiment, the door handle of the present invention can be applied to a door outer handle.

What is claimed is:

1. A door handle for a vehicle including an operation button that is pushed so as to unlock a door of the vehicle, the door handle comprising:

a handle base plate to which said operation button is attached;

a sliding wall provided on said handle base plate, said sliding wall being in sliding contact with said operation button and guiding said operation button;

a rigid elongated arm having a pair of opposing ends, one end of said opposing ends of said arm being movable linearly in a first direction when said operation button is pressed;

guiding means provided between said arm and said handle base plate, said guiding means providing fixed guiding surfaces which slidably and linearly guide the other opposing end of said arm in a second direction substantially perpendicular to said first direction when said arm moves;

an unlocking cable connected to said arm and operable to unlock the door; and urging means arranged to urge said arm in a direction such that said operation button returns to a position at which said operation button was located before being pressed.

2. A door handle for a vehicle according to claim 1, wherein said arm is bent at an intermediate portion thereof such that said arm comprises two portions intersecting one another at an angle at said intermediate portion so as to prevent said sliding wall from interfering with the movement of said arm.

3. A door handle for a vehicle according to claim 1, wherein said guiding means comprises:

a guide slit provided on said handle base plate, said guide slit having a longitudinal direction which extends in said second direction, and a protrusion provided on said the other end of said arm, said protrusion being inserted into said guide slit.

4. A door handle for a vehicle according to claim 1, wherein said guiding means comprises:

a guide slit provided on said arm such that said guide slit extends in a substantially longitudinal direction extending in said second direction, and a protrusion provided on said handle base plate, said protrusion being inserted into said guide slit.

5. A door handle for a vehicle according to claim 1, wherein one end of said urging means is engaged with said another end portion of said arm, and the other end of said urging means is engaged with said handle base plate.

6. A door handle for a vehicle according to claim 1, further comprising:

auxiliary guiding means provided between said arm and said handle base plate, said auxiliary guiding means being constructed and arranged to guide said one end of said arm in said first direction when said arm moves.

7. A door handle for a vehicle according to claim 6, wherein said auxiliary guiding means comprises:

a guide slit provided on said handle base plate, said guide slit having a longitudinal direction which extends in said first direction, and a protrusion provided on said one end of said arm, said protrusion being inserted into said guide slit.

8. A door handle for a vehicle according to claim 6, wherein said auxiliary guiding means comprises:

a guide slit provided on said handle base plate, said guide slit having a longitudinal direction which extends in said first direction, and a protrusion provided on said operation button, said protrusion being engaged with said one end of said arm and being inserted into said guide slit.

9. A door handle for a vehicle including an operation button that is pushed so as to unlock a door of the vehicle, said door handle comprising:

a handle base plate to which said operation button is attached, said handle base plate having a door attachment surface;

a sliding wall provided on said handle base plate, said sliding wall being in sliding contact with said operation button and guiding said operation button;

a rigid elongate arm having a pair of opposing ends, one end of said opposing ends of said arm being movable linearly when said operation button is pressed, said arm being bent at an intermediate portion thereof such that said arm comprises two portions intersecting one another at an angle at said intermediate portion so as to prevent said sliding wall from interfering with the movement of said arm;

guiding means provided between said arm and said handle base plate, said guiding means providing fixed guiding surfaces that slidably guide the other opposing end of said arm in a direction substantially parallel to said door attachment surface when said arm moves;

an unlocking cable connected to said arm and operable to unlock the door; and urging means arranged to urge said arm in a direction such that said operation button returns to a position at which said operation button was located before being pressed.

10. A door handle for a vehicle according to claim 9, wherein said guiding means comprises:

a guide slit provided on said handle base plate, said guide slit having a longitudinal direction which extends in said second direction, and a protrusion provided on the other end of said arm, said protrusion being inserted into said guide slit.

11. A door handle for a vehicle according to claim 9, wherein said guiding means comprises:

a guide slit provided on said arm such that said guide slit extends in a substantially longitudinal direction extending in said second direction, and a protrusion provided on said handle base plate, said protrusion being inserted into said guide slit.

12. A door handle for a vehicle according to claim 9, wherein one end of said urging means is engaged with said the other end of said arm, and another end of said urging means is engaged with said handle base plate.

13. A door handle for a vehicle according to claim 9, further comprising:

auxiliary guiding means provided between said arm and said handle base plate, said auxiliary guiding means being constructed and arranged to guide said one end of said arm in said first direction when said arm moves.

14. A door handle for a vehicle according to claim 13, wherein said auxiliary guiding means comprises:

a guide slit provided on said handle base plate, said guide slit having a longitudinal direction which extends in said first direction, and a protrusion provided on one end of said arm, said protrusion being inserted into said guide slit.

15. A door handle for a vehicle according to claim 13, wherein said auxiliary guiding means comprises:

a guide slit provided on said handle base plate, said guide slit having a longitudinal direction which extends substantially perpendicularly to the door attachment surface of said handle base plate, and a protrusion provided on said operation button, said protrusion being engaged with said one end of said arm and being inserted into said guide slit.

16. A door handle for a vehicle including an operation button that is pushed so as to unlock a door of the vehicle, said door handle comprising:

a handle base plate to which said operation button is attached, said handle base plate having a door attachment surface;

a sliding wall provided on said handle base plate, said sliding wall being in sliding contact with said operation button and guiding said operation button;

a rigid elongate arm having a pair of opposing ends, one end of said opposing ends of said arm being movable linearly when said operation button is pressed, said arm being bent at an intermediate portion thereof such that said arm comprises two portions intersecting one another at an angle at said intermediate portion so as to prevent said sliding wall from interfering with the movement of said arm;

guiding means provided between said arm and said handle base plate, said guiding means providing fixed guiding surfaces that slidably and linearly guide the other opposing end of said arm in a first direction substantially parallel to said door attachment surface of said handle base plate when said arm moves;

auxiliary guiding means provided between said arm and said handle base plate, said auxiliary guiding means guiding said one end of said arm in a second direction extending substantially perpendicularly to the door attachment surface of said handle base plate when said arm moves;

an unlocking cable connected to said arm and operable to unlock the door; and urging means configured to urge said arm in a direction such that said operation button returns to a position at which said operation button was located before being pressed, one end of said urging means being engaged with said the other end portion of said arm, and another end of said urging means being engaged with said handle base plate.

17. A door handle for a vehicle according to claim 16, wherein said guiding means comprises:

a guide slit provided on said handle base plate, said guide slit having a longitudinal direction which extends in said second direction, and a protrusion provided on said the other end of said arm, said protrusion being inserted into said guide slit.

18. A door handle for a vehicle according to claim 16, wherein said guiding means comprises:

a guide slit provided on said arm such that said guide slit extends in a substantially longitudinal direction extending in said second direction, and a protrusion provided on said handle base plate, said protrusion being inserted into said guide slit.

19. A door handle for a vehicle according to claim 16, wherein said auxiliary guiding means comprises:

a guide slit provided on said handle base plate, said guide slit having a longitudinal direction which extends in said first direction, and a protrusion provided on said one end of said arm, said protrusion being inserted into said guide slit.

20. A door handle for a vehicle according to claim 16, wherein said auxiliary guiding means comprises:

a guide slit provided on said handle base plate, said guide slit having a longitudinal direction which extends in said first direction, and a protrusion provided on said operation button, said protrusion being in contact with said one end of said arm and being inserted into said guide slit.

21. A door handle assembly configured to be mounted on a door of a vehicle, the door handle assembly comprising:

a handle base plate having a door attachment surface configured to be attached to a vehicle door;

an operation button configured to be manually pushed from a normal position to an actuated position, said handle base plate having a sliding wall, said sliding wall being engaged in sliding contact with said operation button and guiding said operation button during movement of said operation button between said normal position thereof and said actuated position thereof;

a rigid elongate arm having a pair of opposing ends, said arm being configured to move in an unlocking direction when one end of said opposing ends thereof is moved in response to manual pushing of said operation button from said normal position thereof to said actuated position thereof, said one end of said arm moving linearly in a first direction extending substantially orthogonally to said door attachment surface during movement of said arm in said unlocking direction thereof;

guiding means provided between said arm and said handle base plate, said guiding means providing fixed guiding surfaces which slidably guide the other end of said opposing ends of said arm in a second direction extending substantially parallel to said door attachment surface during movement of said arm in said unlocking direction in response to manual pushing of said operation button from said normal position thereof to said actuated position thereof;

an unlocking cable connected to said arm and operable to unlock the door in response to manual pushing of said operation button from said normal position thereof to said actuated position thereof when said door handle assembly is mounted on the vehicle door; and biasing means constructed and arranged to bias said arm in a return direction such that said operation button returns from said actuated position thereof to said normal position thereof after being manually released.

22. A door handle assembly according to claim 21, wherein said arm is bent at an intermediate portion thereof such that said arm comprises two portions intersecting one another at an angle at said intermediate portion so as to prevent said sliding wall from interfering with the movement of said arm.

23. A door handle assembly according to claim 21, wherein said guiding means comprises:

a guide slit provided on said handle base plate, said guide slit having a longitudinal direction which extends along the door attachment surface of said handle base plate, and a protrusion provided on said the other end of said arm, said protrusion being inserted into said guide slit.

24. A door handle assembly according to claim 21, wherein said guiding means comprises:

a guide slit provided on said arm such that said guide slit extends in a substantially longitudinal direction extending from said the other end of said arm, and a protrusion provided on said handle base plate, said protrusion being inserted into said guide slit.

25. A door handle assembly according to claim 21, wherein one end of said biasing means is engaged with said the other end of said arm, and another end of said biasing means opposite said one end thereof is engaged with said handle base plate.

26. A door handle assembly according to claim 21, further comprising:

auxiliary guiding means provided between said arm and said handle base plate, said auxiliary guiding means being constructed and arranged to guide said one end of said arm in a direction extending substantially perpendicular to the door attachment surface of said handle base plate during movement of said arm in said unlocking direction in response to manual pushing of said operation button from said normal position thereof actuated position thereof.

27. A door handle assembly according to claim 26, wherein said auxiliary guiding means comprises:

a guide slit provided on said handle base plate, said guide slit having a longitudinal direction which extends substantially perpendicularly to the door attachment surface of said handle base plate, and a protrusion provided on said one end of said arm, said protrusion being inserted into said guide slit.

28. A door handle assembly according to claim 26, wherein said auxiliary guiding means comprises:

a guide slit provided on said handle base plate, said guide slit having a longitudinal direction which extends substantially perpendicularly to the door attachment surface of said handle base plate, and a protrusion provided on said operation button, said protrusion being engaged with said one end of said arm and being inserted into said guide slit.

29. A door handle assembly configured to be mounted on a door of a vehicle, said door handle assembly comprising:

a handle base plate having a door attachment surface configured to be attached to the door;

an operation button configured to be manually pushed from a normal position to an actuated position:

said handle base plate having a sliding wall, said sliding wall being engaged in sliding contact with said operation button and guiding said operation button during movement of said operation button between said normal position thereof and actuated position thereof;

a rigid elongate arm having a pair of opposing ends, one end of said pair of opposing ends being movable linearly in an unlocking direction when one end of said arm is moved in response to manual pushing of said operation button from said normal position thereof to said actuated position thereof, said arm being bent at an intermediate portion thereof such that said arm comprises two portions intersecting one another at an angle at said intermediate portion so as to prevent said sliding wall from interfering with the movement of said arm;

guiding means provided between said arm and said handle base plate, said guiding means providing fixed guiding surfaces which slidably guide the other end of said opposing ends of said arm in a direction substantially parallel to said door attachment surface during movement of said arm in said unlocking direction in response to manual pushing of said operation button from said normal position thereof to said actuated position thereof;

an unlocking cable connected to said arm and operable to unlock the door in response to manual pushing of said operation button when said door handle assembly is mounted on the vehicle door; and biasing means constructed and arranged to bias said arm in a return direction such that said operation button returns from said actuated position thereof to said normal position thereof after being manually released.

30. A door handle assembly according to claim 29, wherein said guiding means comprises:

a guide slit provided on said handle base plate, said guide slit having a longitudinal direction which extends substantially parallel to the door attachment surface of said handle base plate, and a protrusion provided on the other end of said arm said protrusion being inserted into said guide slit.

31. A door handle assembly according to claim 29, wherein said guiding means comprises:

a guide slit provided on said arm such that said guide slit extends in a substantially longitudinal direction extending from said the other end of said arm, and a protrusion provided on said handle base plate, said protrusion being inserted into said guide slit.

32. A door handle assembly according to claim 29, wherein one end of said biasing means is engaged with said the other end of said arm, and another end of said biasing means is engaged with said handle base plate.

33. A door handle assembly according to claim 29, further comprising:

auxiliary guiding means provided between said arm and said handle base plate, said auxiliary guiding means being constructed and arranged to guide said one end of said arm in a direction extending substantially perpendicular to the door attachment surface of said handle base plate during movement of said arm in said unlocking direction in response to manual pushing of said operation button from said normal position thereof to said actuated position thereof.

34. A door handle assembly according to claim 33, wherein said auxiliary guiding means comprises:

a guide slit provided on said handle base plate, said guide slit having a longitudinal direction which extends substantially perpendicularly to the door attachment surface of said handle base plate, and a protrusion provided on one end of said arm, said protrusion being inserted into said guide slit.

35. A door handle assembly according to claim 33, wherein said auxiliary guiding means comprises:

a guide slit provided on said handle base plate, said guide slit having a longitudinal direction which extends substantially perpendicularly to the door attachment surface of said handle base plate, and a protrusion provided on said operation button, said protrusion being engaged with said one end of said arm and being inserted into said guide slit.

36. A door handle assembly configured to be mounted on a door of a vehicle, said door handle assembly comprising:

a handle base plate having a door attachment surface that attaches to the door;

an operation button configured to be manually pushed from a normal position to an actuated position;

said handle base plate having a sliding wall, said sliding wall being engaged in sliding contact with said operation button and guiding said operation button during movement of said operation button between said normal position thereof and said actuated position thereof;

a rigid elongate arm having a pair of opposing ends, one end of said pair of opposing ends being movable linearly in an unlocking direction when said operation button is manually pushed from said normal position thereof to said actuated position thereof, said arm being bent at an intermediate portion thereof such that said arm comprises two portions intersecting one another at an angle at said intermediate portion so as to prevent said sliding wall from interfering with the movement of said arm;

guiding means provided between said arm and said handle base plate, said guiding means being configured to guide the other end of said pair of opposing ends of said arm in a direction extending substantially parallel to said door attachment surfaces during movement of said arm in said unlocking direction in response to manual pushing of said operation button from said normal position thereof to said actuated position thereof;

auxiliary guiding means provided between said arm and said handle base plate, said auxiliary guiding means guiding said one end of said arm in a direction extending substantially perpendicularly to the door attachment surface of said handle base plate during movement of said arm in response to manual pushing of said operation button from said normal position thereof to said actuated position thereof;

an unlocking cable connected to said arm and operable to unlock the door in response to manual pushing of said operation button from said normal position thereof to the actuated position thereof when said door handle assembly is mounted on the vehicle door; and biasing means constructed and arranged to bias said arm in a return direction such that said operation button returns from said actuated position thereof to said normal position thereof after being manually released, one end of said biasing means being engaged with said the other end of said arm, and another end of said biasing means being engaged with said handle base plate.

37. A door handle assembly according to claim 36, wherein said guiding means comprises:

a guide slit provided on said handle base plate, said guide slit having longitudinal direction which extends along the door attachment surface of said handle base plate, and a protrusion provided on said another end of said arm, said protrusion being inserted into said guide slit.

38. A door handle assembly according to claim 36, wherein said guiding means comprises:

a guide slit provided on said arm such that said guide slit extends in a substantially longitudinal direction extending from said the other end of said arm, and a protrusion provided on said handle base plate, said protrusion being inserted into said guide slit.

39. A door handle assembly according to claim 36, wherein said auxiliary guiding means comprises:

a guide slit provided on said handle base plate, said guide slit having a longitudinal direction which extends substantially perpendicularly to the door attachment surface of said handle base plate, and a protrusion provided on said one end of said arm, said protrusion being inserted into said guide slit.

40. A door handle assembly according to claim 36, wherein said auxiliary guiding means comprises:

a guide slit provided on said handle base plate, said guide slit having a longitudinal direction which extends substantially perpendicularly to the door attachment surface of said handle base plate, and a protrusion provided on said operation button, said protrusion being in contact with said one end of said arm and being inserted into said guide slit.

* * * * *